US008079569B2

(12) United States Patent
Lesko

(10) Patent No.: US 8,079,569 B2
(45) Date of Patent: Dec. 20, 2011

(54) CABLE DRAWWORKS FOR A DRILLING RIG

(76) Inventor: Gerald Lesko, Edmonton (CA)

( * ) Notice: Subject to any disclaimer, the term of this patent is extended or adjusted under 35 U.S.C. 154(b) by 405 days.

(21) Appl. No.: 12/349,176

(22) Filed: Jan. 6, 2009

(65) Prior Publication Data

US 2009/0114892 A1 May 7, 2009

Related U.S. Application Data

(63) Continuation-in-part of application No. 11/268,258, filed on Nov. 7, 2005, now Pat. No. 7,527,245.

(30) Foreign Application Priority Data

Apr. 29, 2005 (CA) ..... 2505989

(51) Int. Cl.
*B66D 1/26* (2006.01)

(52) U.S. Cl. ..... 254/344; 254/358

(58) Field of Classification Search ..... 254/344, 254/358, 342, 378, 362, 363
See application file for complete search history.

(56) References Cited

U.S. PATENT DOCUMENTS

| | | | | |
|---|---|---|---|---|
| 1,874,625 | A * | 8/1932 | Rice | 188/264 D |
| 1,875,769 | A * | 9/1932 | Spalding | 254/378 |
| 2,351,654 | A | 6/1944 | Anderson | |
| 2,505,088 | A | 4/1950 | Athy | |
| 2,635,851 | A * | 4/1953 | Maier | 254/358 |
| 2,725,213 | A * | 11/1955 | McElvy | 254/337 |
| 2,950,086 | A | 12/1957 | Abraham | |
| 3,738,614 | A | 6/1973 | Peterson | |
| 4,177,973 | A | 12/1979 | Miller et al. | |
| 4,227,680 | A | 10/1980 | Hrescak | |
| 4,328,954 | A | 5/1982 | Logus | |
| 4,438,904 | A * | 3/1984 | White | 254/311 |
| 4,438,905 | A | 3/1984 | White | |
| 4,520,900 | A | 6/1985 | Orgeron | |
| 4,616,735 | A | 10/1986 | Orgeron | |
| 5,211,124 | A | 5/1993 | Reiser | |
| 5,425,435 | A | 6/1995 | Gregory | |
| 5,586,617 | A | 12/1996 | England et al. | |
| 5,842,684 | A | 12/1998 | Aho | |
| 5,921,529 | A | 7/1999 | Wilson et al. | |
| 6,182,945 | B1 | 2/2001 | Dyer et al. | |
| 6,827,120 | B2 | 12/2004 | Last | |
| 7,210,670 | B2 | 5/2007 | Franks | |

(Continued)

FOREIGN PATENT DOCUMENTS

| | | |
|---|---|---|
| CA | 1153063 | 8/1983 |

(Continued)

*Primary Examiner* — Emmanu M Marcelo
(74) *Attorney, Agent, or Firm* — Dinsmore & Shohl LLP

(57) ABSTRACT

A cable drawworks for a drilling rig is provided having a three-phase AC electric motor controlled by a variable frequency drive control system. A primary drive transmission consisting of a chain and sprockets connects the motor to a drum shaft that passes through the hub of a cable drum such that the cable drum is rotatably mounted on the drum shaft. The drum shaft connects to a secondary drive transmission, attached to the frame via an oscillating plate assembly, that connects the drum shaft to the cable drum. Each end of the cable drum has a brake drum and a brake band wrapped around thereon. A brake actuating system is used to tighten the bands around each drum during braking conditions and includes an equalization linkage system between the brake bands resulting in equal braking forces being applied to each brake drum.

31 Claims, 15 Drawing Sheets

U.S. PATENT DOCUMENTS

| | | | | |
|---|---|---|---|---|
| 7,232,113 | B2 | 6/2007 | Heinrichs et al. | |
| 7,556,240 | B1 * | 7/2009 | Bauer et al. | 254/294 |
| 1,953,865 | A1 | 9/2009 | Penick et al. | |
| 1,998,013 | A1 | 9/2009 | Greve | |
| 2005/0006633 | A1 * | 1/2005 | Franks | 254/378 |
| 2008/0116432 | A1 * | 5/2008 | Folk et al. | 254/362 |
| 2008/0277637 | A1 * | 11/2008 | Heinrichs | 254/342 |

FOREIGN PATENT DOCUMENTS

| | | |
|---|---|---|
| CA | 1285401 | 7/1991 |
| CA | 2114807 | 10/1994 |
| CA | 2310615 | 7/1999 |
| CA | 2372327 | 11/2000 |

* cited by examiner

CABLE DRAWWORKS FOR A DRILLING RIG

CROSS REFERENCE TO RELATED APPLICATIONS

This application is a continuation-in-part of U.S. application Ser. No. 11/268,258 filed Nov. 7, 2005, the entire disclosure of which is hereby incorporated by reference herein.

TECHNICAL FIELD

The present disclosure relates to the field of cable drawworks mechanisms for use in raising and lowering traveling blocks within drilling rigs.

BACKGROUND

Cable drawworks mechanisms have been used in drilling rigs for decades. Cable drawworks are, typically, motor-driven drums used to reel in or pay out a cable used on the drilling rig to raise or lower a traveling block within the rig. The cable will typically be used with pulleys and pulley blocks attached to the top of the rig and the traveling block, respectively. The traveling block is used for tripping pipe in and out a drill string, as well known to those skilled in the art. Various methods and devices have been developed for this purpose.

U.S. Pat. No. 2,505,088 issued to Athy teaches the use of two cable drums attached to either end of the cable coupled to a traveling block within a drilling rig through a series of pulleys. Having two drums doubles the speed that the cable can be reeled in or paid out resulting in doubling the speed that the traveling block can be raised or lowered within the drilling rig. The disadvantage of such a device is that two cable drums are required for this which increases the amount of space needed for the drums. Furthermore, additional drive train components are required for applying power from a motor to turn the two drums.

U.S. Pat. No. 4,438,904 issued to White teaches a drawworks mechanism that comprises a number of intermediary shafts having clutches that may engage or disengage power from an input drive shaft to the intermediary shaft. The mechanism consists of a number of chain and sprocket drive means for coupling rotation of power from one shaft to another. The disadvantage of this system is the physical space required to house such a mechanism on a drilling rig platform.

U.S. Pat. No. 6,182,945 issued to Dyer et al. teaches a complex drawworks mechanism comprising the use of redundant motors and gear transmissions for applying power to the cable drum. The disadvantage of this system is the significant size of the mechanism which necessitates that the mechanism be located apart and away from the drilling platform.

It is, therefore, desirable to have a drawworks mechanism that is compact enough so that it may be located directly on a drilling platform yet having sufficient power and braking ability to safely reel in and pay out cable for raising and lowering a traveling block within a drilling rig.

SUMMARY

A cable drawworks mechanism for a drilling rig is provided that overcomes the shortcomings identified in the prior art. In one embodiment, the drawworks can comprise a frame that has a footprint compact enough to allow it to be located on a drilling rig platform. The frame can comprise at least a floor member having opposing sidewall members.

The frame can have a motor mounted on it with a drive shaft configured in a horizontal position. A drum shaft having first and second ends can be rotatably disposed between the frame sidewalls such that it is substantially parallel to the motor's drive shaft. A primary drive means can couple the drive shaft to the first end of the drum shaft. The primary drive means can be any suitable coupling mechanism such as a chain and sprockets, a belt and pulleys, a set of intermeshed gears or any other means as well known to those skilled in the art. In a representative embodiment, the primary drive means can comprise a triplex chain and sprocket system having a gear ratio in the range of 1.5:1 to 2:1. A cable drum can be rotatably mounted on the drum shaft and can be concentrically disposed about the drum shaft between the first and second ends. A secondary drive means can couple the drum shaft to the cable drum on the second end side of the drum shaft. In one embodiment, the secondary drive means can comprise a planetary gear transmission having a sun gear, a ring gear and a planetary gear set as well known to those skilled in the art. The sun gear can be disposed about the second end of the drum shaft whereas the ring gear can be operatively coupled to the frame and the planetary gear set operatively coupled to the cable drum. In this configuration, when the drum shaft rotates, the sun gear rotates the planetary gear set that, in turn, rotates the cable drum. In a representative embodiment, the planetary gear transmission can have a 4:1 gear ratio such that the overall gear ratio from the motor to the cable drum can be in the range of 6:1 to 8:1.

In one embodiment, the primary drive side of the drum shaft can be supported by bearings fastened or otherwise secured to the frame thereby allowing the drum shaft to rotate freely yet be affixed in its position relative to the frame. In a further embodiment, the secondary drive means can be attached or otherwise secured to the frame via an oscillating plate assembly or mechanism. The oscillating plate assembly can comprise a first or inner plate that can be attached or fastened to the secondary drive means, a second or outer plate that can be attached or fastened to the frame. The first or inner plate can be attached to the second or outer plate via the use of rollers or spherical bushings that provide means for attaching the plates together yet still allow the plates to rotationally move, tilt and/or oscillate relative to one another. The use of the oscillating plate assembly can allow the drum shaft and cable drum to be securely mounted in the frame yet still allow the rotating components of the drawworks to move or flex slightly in the frame when the drawworks is in operation. If the secondary drive means end of the drum shaft were just simply secured or fastened to the frame, the vibrations and stresses in the rotating components that occur when the drawworks is in operation can result in stress fractures in the frame over time and may result in a catastrophic failure of the drawworks if left unchecked. The use of the oscillating plate assembly to attach the secondary drive means to the frame can reduce or eliminate the probability of such a failure occurring.

The cable drum can also comprise brake means for controlling and braking the rotation of the cable drum. In one embodiment, the brake means can comprise at least one band brake mechanism disposed at one end of the cable drum, as well known to those skilled in the art. In a further embodiment, there can be a band brake mechanism on each end of the cable drum. A mechanism controlling the brake bands can be used to release the bands from the brake drums. In one embodiment, the brake control mechanism is activated to allow the cable drum to rotate. The mechanism is released or deactivated in order for the brake bands to engage the brake drums. In a representative embodiment, a pneumatically-operated air pot can be used although other mechanisms may be used to operate the brake mechanism as well known to those skilled in the art. The use of band brakes, and their inherit nature to be self-actuating, can provide a safe braking mechanism that offers superior protection against the cable drum entering into a runaway condition. While the representative embodiment can use band brakes, it should be apparent to one skilled in the art that other types of braking mechanisms may be used to control the brake drum rotation. These would include disc brakes and drum brakes among others.

The motor used in the present invention can be an electric motor, an internal combustion motor or a hydraulic motor. In one embodiment, a 3-phase AC electric motor is used. The motor can be coupled to a motor control means for controlling the operation of the motor. In another embodiment, a variable frequency drive motor controller mechanism can be used to control the operation of the motor although other control means may be used as well known to those skilled in the art. The motor control means can be used to control the rotation direction and rotational speed of the motor so that the motor can operate the cable drum to either reel in or pay out a cable attached to the cable drum. The cable is fed to a pulley mounted on top of a drilling rig and then downward within the rig to a traveling block which is raised or lowered when the cable drum reels in or pays out the cable.

Broadly stated, a cable drawworks for a drilling rig is provided, comprising: a frame adapted for mounting on a drilling rig, the frame having a floor member and two opposing sidewall members; motor means for operating a cable drum, the motor means mounted on the frame, the motor means having a drive shaft; a drum shaft having first and second ends, the drum shaft rotatably disposed in the frame; primary drive means for rotatably coupling the drive shaft to the first end of the drum shaft; the cable drum rotatably mounted on the drum shaft, the cable drum located between the first and second ends on the drum shaft; secondary drive means for rotatably coupling the second end of the drum shaft to the cable drum; and an oscillating plate assembly adapted for operatively attaching the secondary drive means to the frame.

Broadly stated, another embodiment of a cable drawworks for a drilling rig is provided, comprising: a frame adapted for mounting on a drilling rig, the frame having a floor member and two opposing sidewall members; a motor mounted on the frame, the motor having a drive shaft; a drum assembly rotatably disposed in the frame, the drum assembly further comprising a drum shaft having first and second ends; primary drive means for rotatably coupling the drive shaft to the first end of the drum shaft; a cable drum concentrically mounted on the drum shaft whereby the cable drum can rotate about the drum shaft, the cable drum located between the first and second ends on the drum shaft; secondary drive means for rotatably coupling the second end of the drum shaft to the cable drum; and mounting means for operatively attaching the secondary drive means to the frame, the mounting means configured to allow the drum assembly to move or flex within the frame when the drawworks is in operation.

DETAILED DESCRIPTION OF EMBODIMENTS

Figure 1:
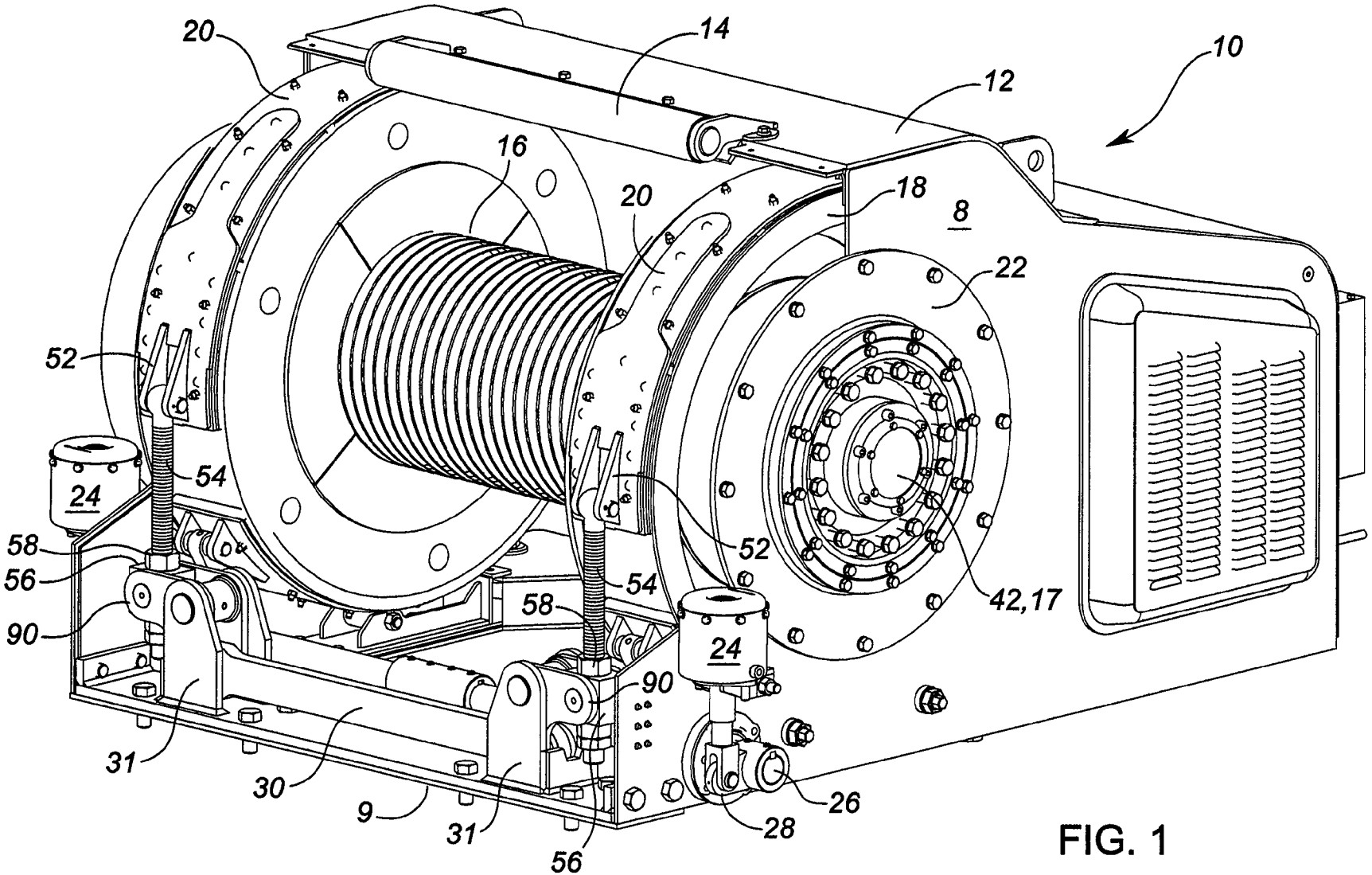
FIG. 1 is a perspective cutaway view depicting a cable drawworks.
Figure 2:
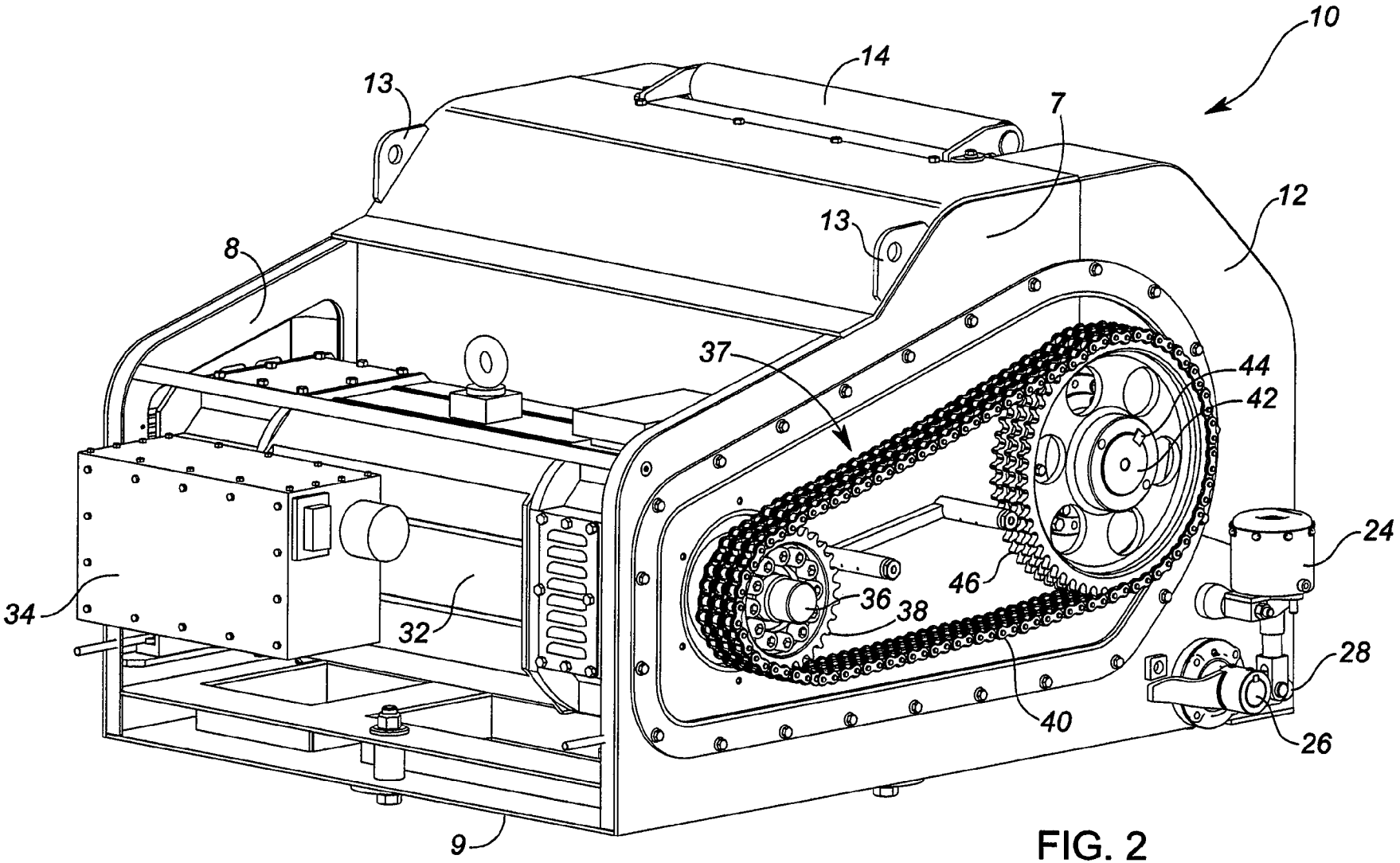
FIG. 2 is a rear perspective cutaway view depicting the drawworks of FIG. 1.
Figure 3:
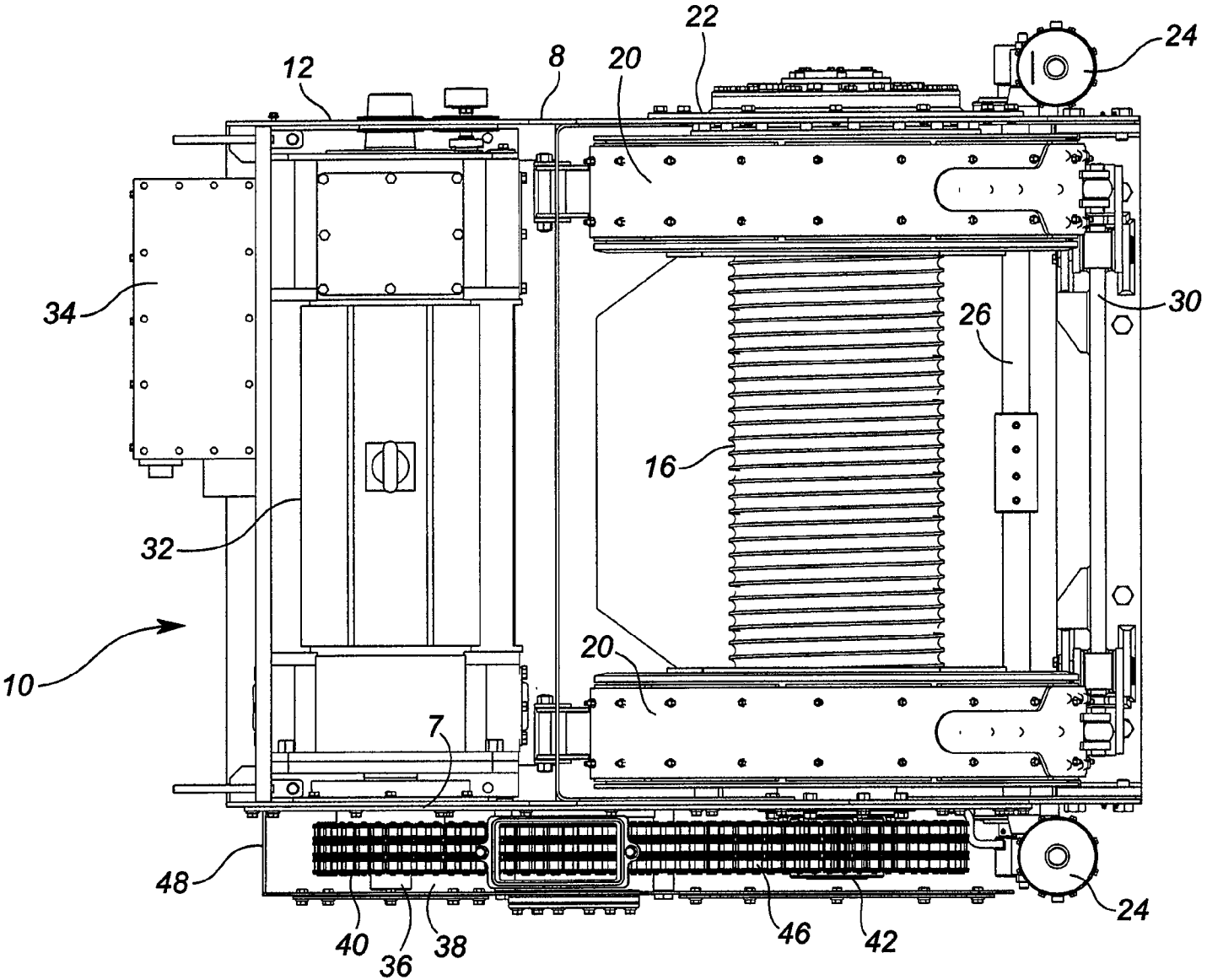
FIG. 3 is a top plan cutaway view depicting the drawworks of FIG. 1.

Referring to FIGS. 1 to 5, one embodiment of a cable drawworks is shown. Drawworks 10 can comprise of frame 12 having floor 9, right sidewall 8 and left sidewall 7. Motor 32 can be mounted on floor 9. In one embodiment, motor 32 can be a three-phase AC electric motor such as manufactured by Oilfield-Electric-Marine Inc. of Houston, Tex., U.S.A., Model No. TT600 series although other types of similar power capability may be used. In a representative embodiment, motor 32 can operate at 600 volts AC and can produce up to 5,000 ft.-lb. of torque. In a representative embodiment, drawworks 10 can have approximate overall dimensions of 69" wide by 86" long by 50" tall. These dimensions permit drawworks 10 to be mounted on a drilling rig floor instead of being situated in a location near the drilling rig thereby reducing the physical space required for drilling operations.

In one embodiment, motor 32 can have a motor shaft 36 whose longitudinal axis is generally horizontal when motor 32 is mounted on frame 12. In another embodiment, motor 32 can be controlled by motor controller 34. Motor controller 34 can control the direction and rotational speed of motor 32. Motor controller 34 can be any type of 3-phase AC motor controller. In a representative embodiment, motor controller 34 can be a variable frequency drive motor controller. In this embodiment, motor controller 34 is manufactured by Oilfield-Electric-Marine Inc. of Houston, Tex., U.S.A. and is designed to operate with their TT600 series of AC electric motors. It is obvious to those skilled in the art that any suitable and/or comparable electric motor and motor controller can be used in the cable drawworks.

Figure 4:
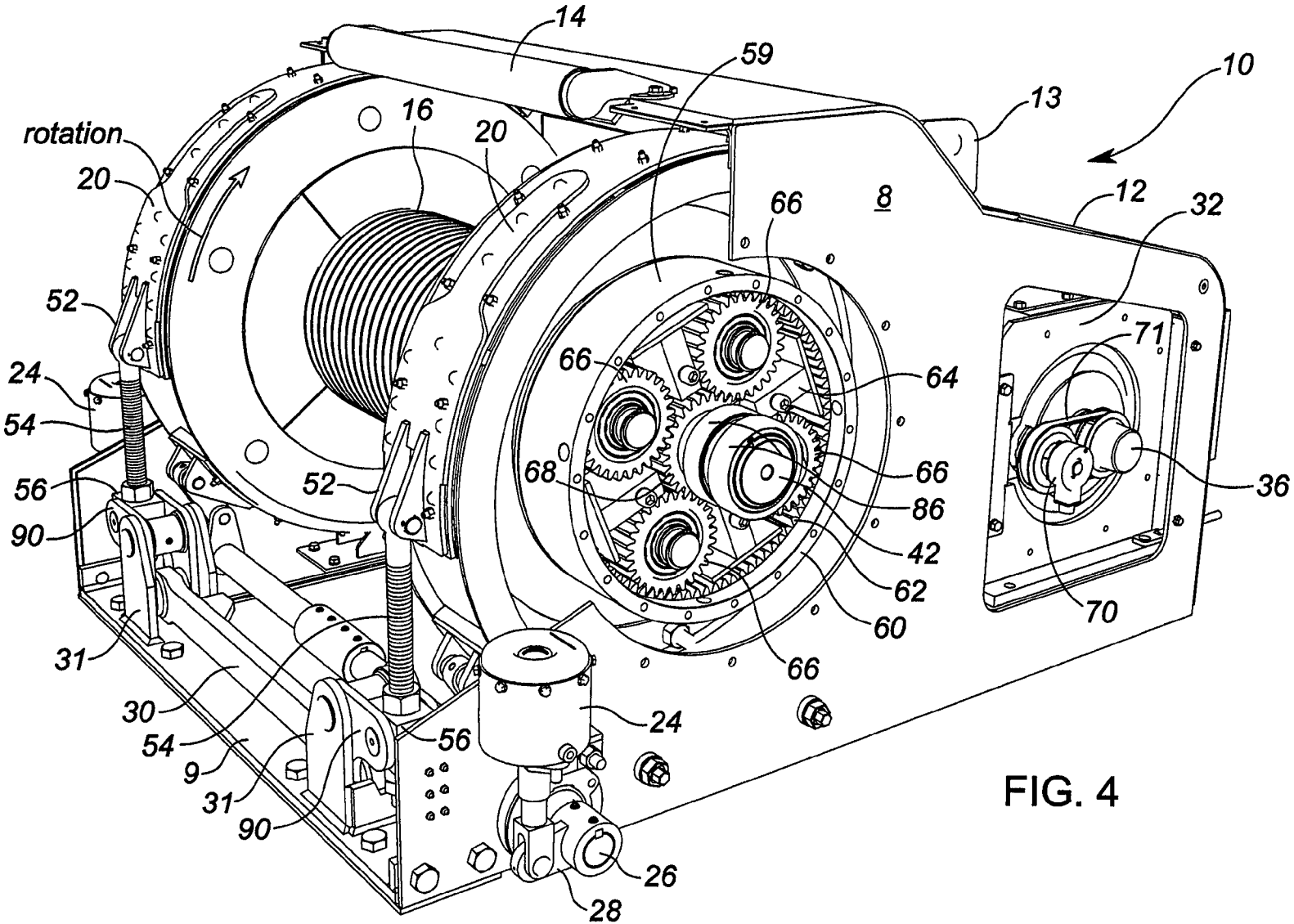
FIG. 4 is a front perspective cutaway view depicting the drawworks of FIG. 1.

Referring to FIG. 4, motor shaft 36 can be coupled to encoder 70 by belt 71. Encoder 70 can be used to provide information to motor controller 34 such as motor speed, in revolutions per minute, and motor direction. In a representative embodiment, encoder 70 can be model HS35 as manufactured by BEI Technologies Inc. of Goleta, Calif., U.S.A. An additional encoder (not shown) can be operatively coupled to cable drum 16. These encoders can provide information to motor controller 34 that enables drawworks 10 to operate in a number of modes. These modes can include automated drilling operations, hoisting up or down operations and emergency stopping operations.

Figure 6:
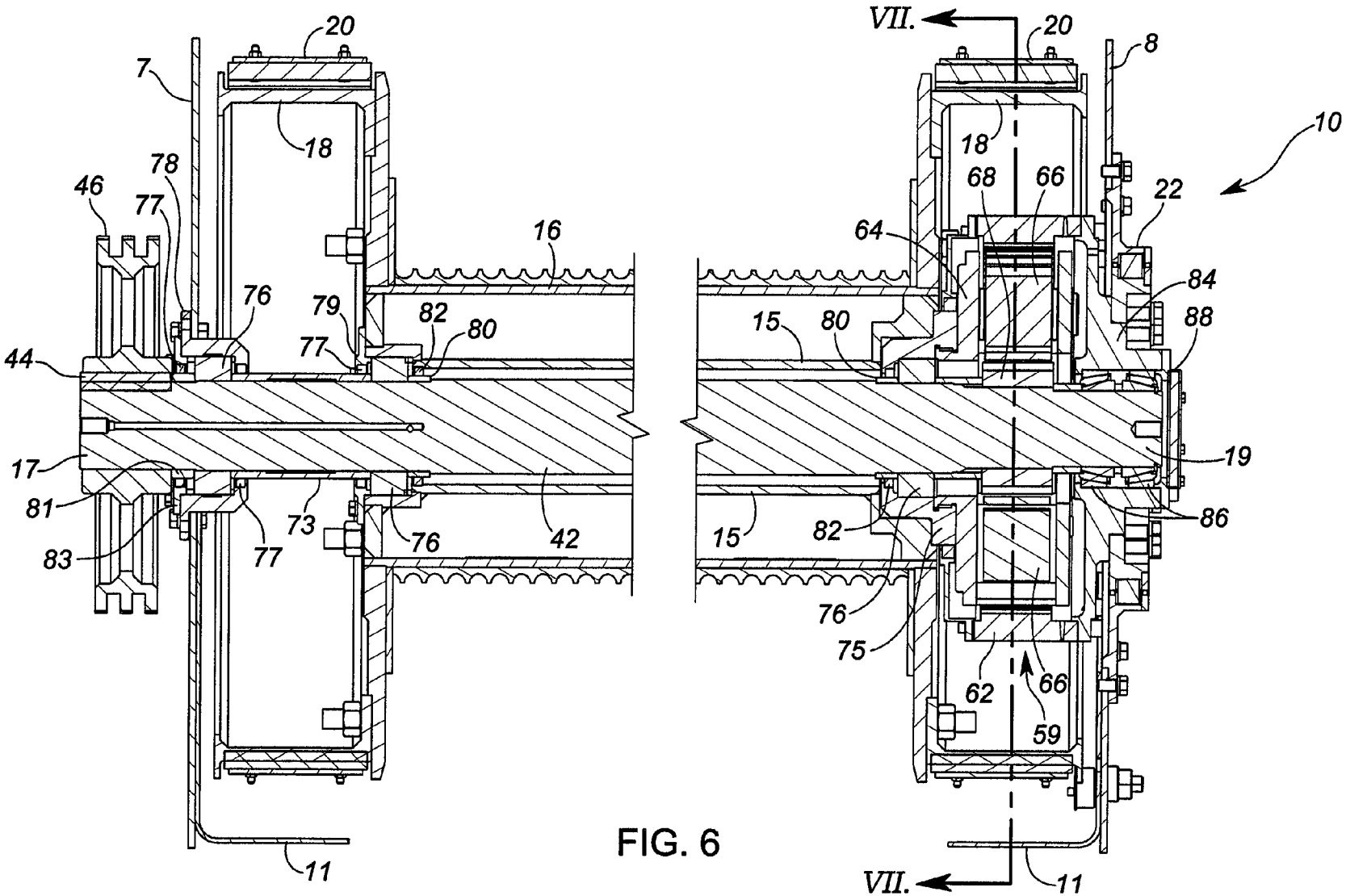
FIG. 6 is a cross-sectional view depicting the drum assembly of the drawworks of FIG. 5 shown along section lines VI-VI.

In one embodiment, drum shaft 42, having right end 17 and left end 19, can be rotatably mounted on frame 12 between sidewalls 7 and 8. In one embodiment, drum shaft 42 can be positioned such that it is generally parallel to motor shaft 36. Cable drum 16 can be rotatably mounted on drum shaft 42 between right end 17 and left end 19 via roller bearings 76 as shown in FIG. 6. This configuration allows cable drum 16 to rotate freely and independently on drum shaft 42.

In one embodiment, primary drive 37 can couple motor shaft 36 to left end 19 of drum shaft 42. In another embodiment, primary drive 37 can comprise drive sprocket 38 mounted on motor shaft 36, sprocket 46 mounted on left end 19 of drum shaft 42 and chain 40 coupling drive sprocket 38 to sprocket 46. In this embodiment, chain 40 can be a triple row or triplex chain and sprockets 38 and 46 can be triplex chain sprockets. In another embodiment, primary drive cover 48 can cover primary drive 37. Cover 48 can have inspection points 49 and 50 to permit the visual inspection of chain 40. It should be obvious to those skilled in the art that other means may be used in the primary drive transmission such as a primary drive belt and sprockets or intermeshed gears. In a representative embodiment, primary drive 37 can provide a primary gear reduction from motor 32 to drum shaft 42. The gear reduction ratio can be in the range of 1.5:1 to 2:1. In this embodiment, drive sprocket 38 can have 28 teeth and sprocket 36 can have 52 teeth resulting in a gear reduction ratio of 1.86:1.

Figure 5:
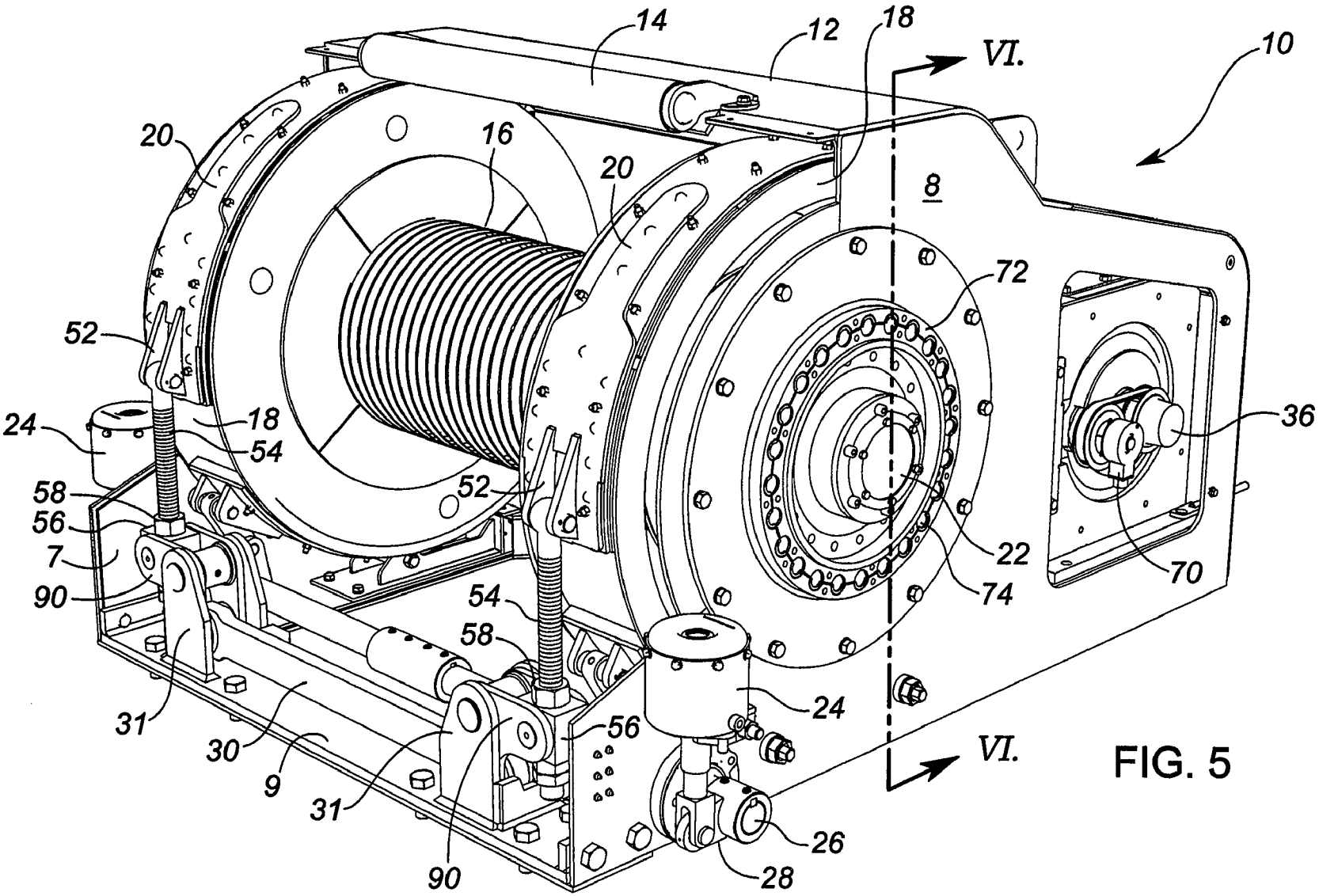
FIG. 5 is a front perspective view depicting the drawworks of FIG. 1.
Figure 7:
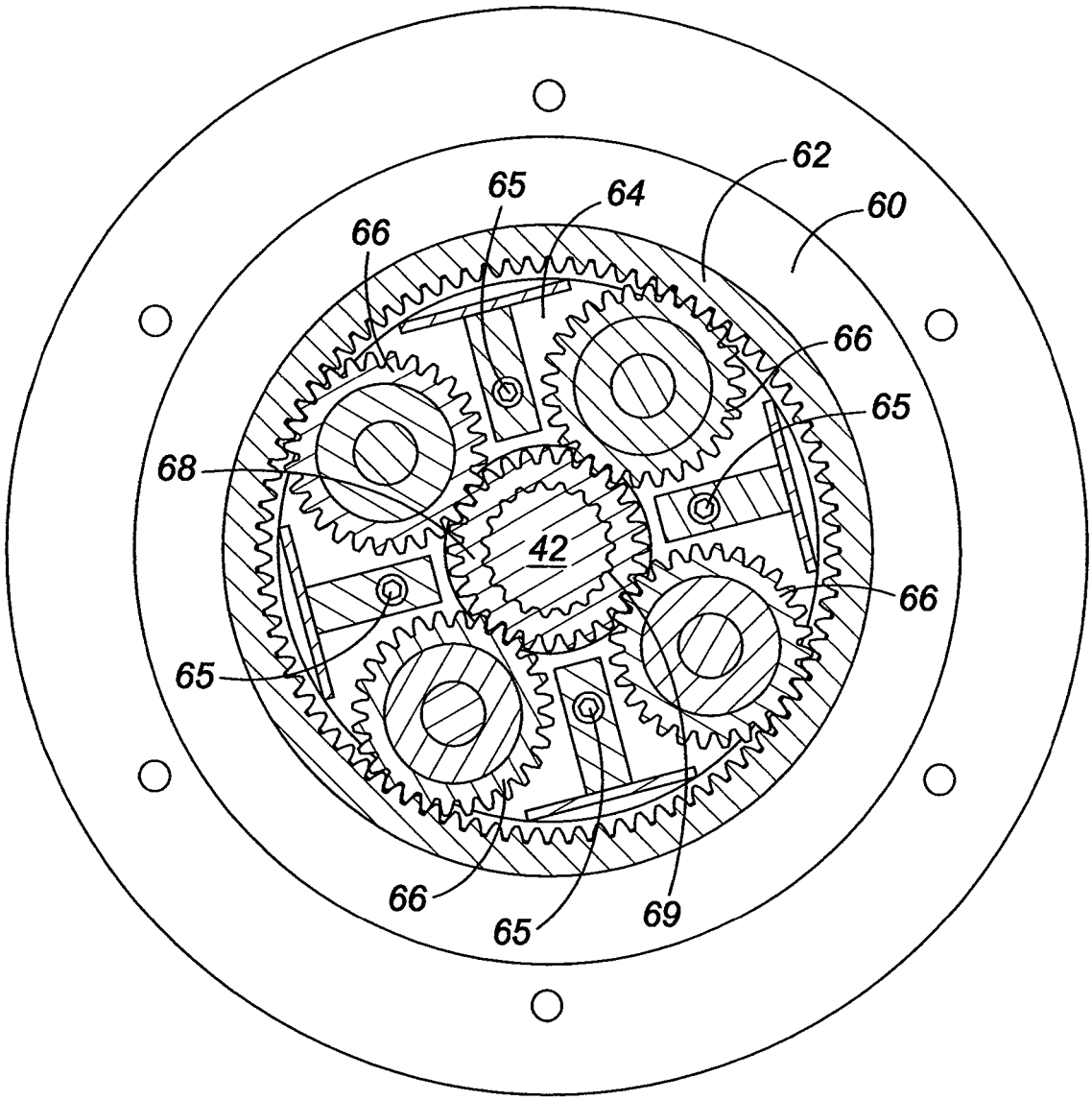
FIG. 7 is a cross-sectional end elevational view depicting the planetary gear transmission of the drum assembly of FIG. 6 shown along section lines VII-VII.
Figure 8:
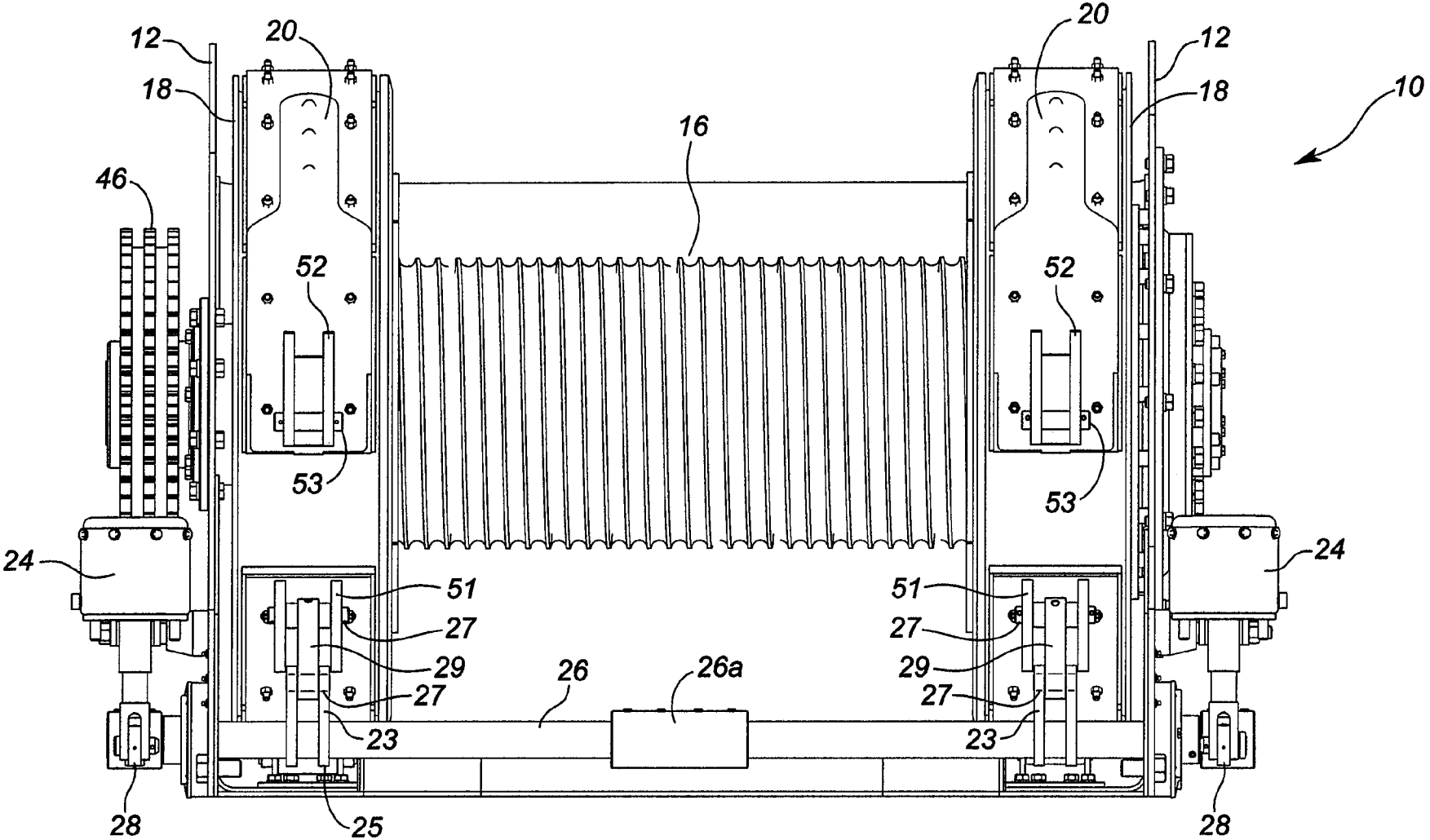
FIG. 8 is a front elevation view depicting the drawworks of FIG. 1.
Figure 9:
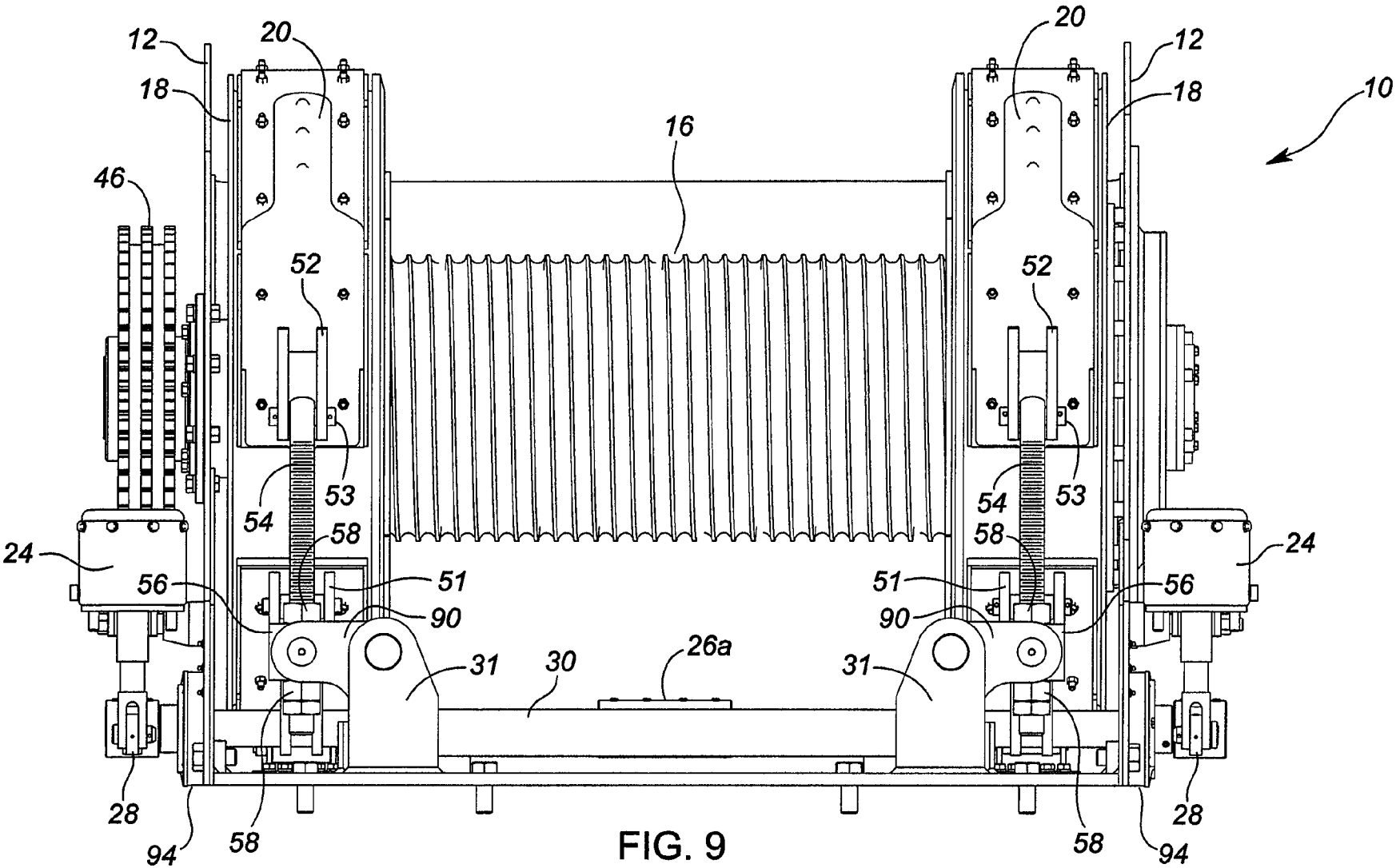
FIG. 9 is a front elevation view depicting the equalizer brake linkage of the drawworks of FIG. 8.
Figure 10:
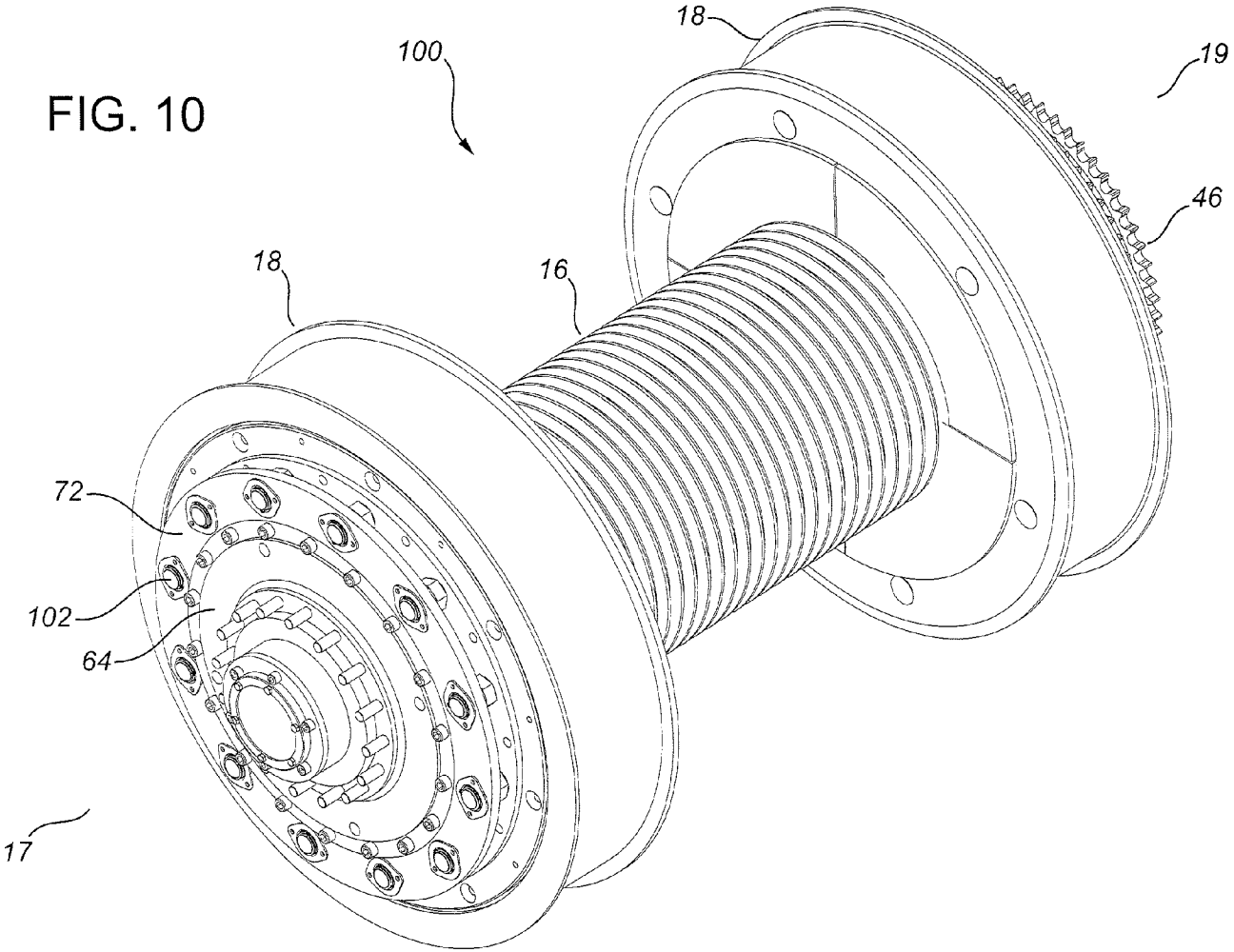
FIG. 10 is a perspective view depicting one embodiment of the drum assembly of the drawworks of FIG. 1.
Figure 11:
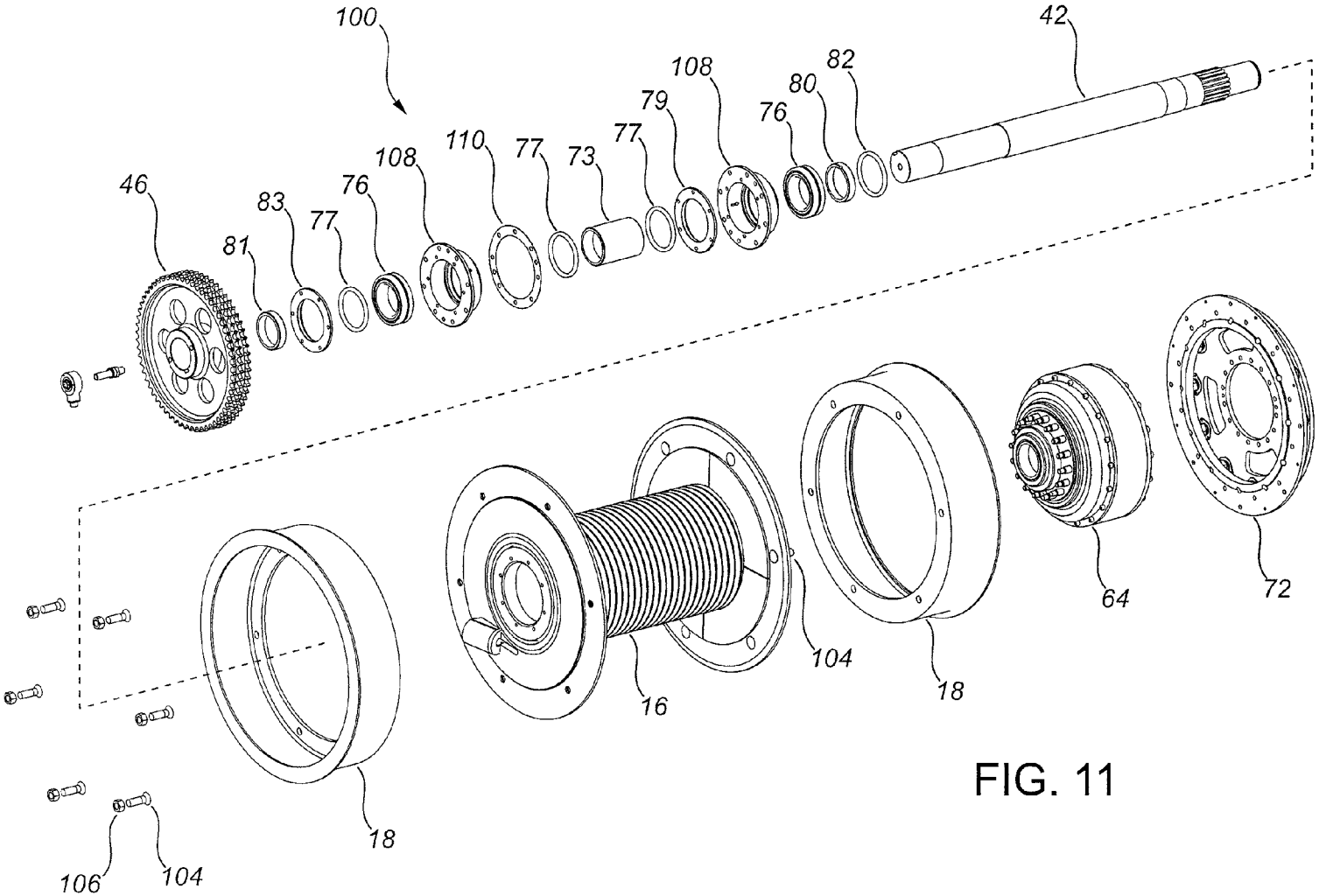
FIG. 11 is an exploded perspective view depicting the drum assembly of FIG. 10.
Figure 12:
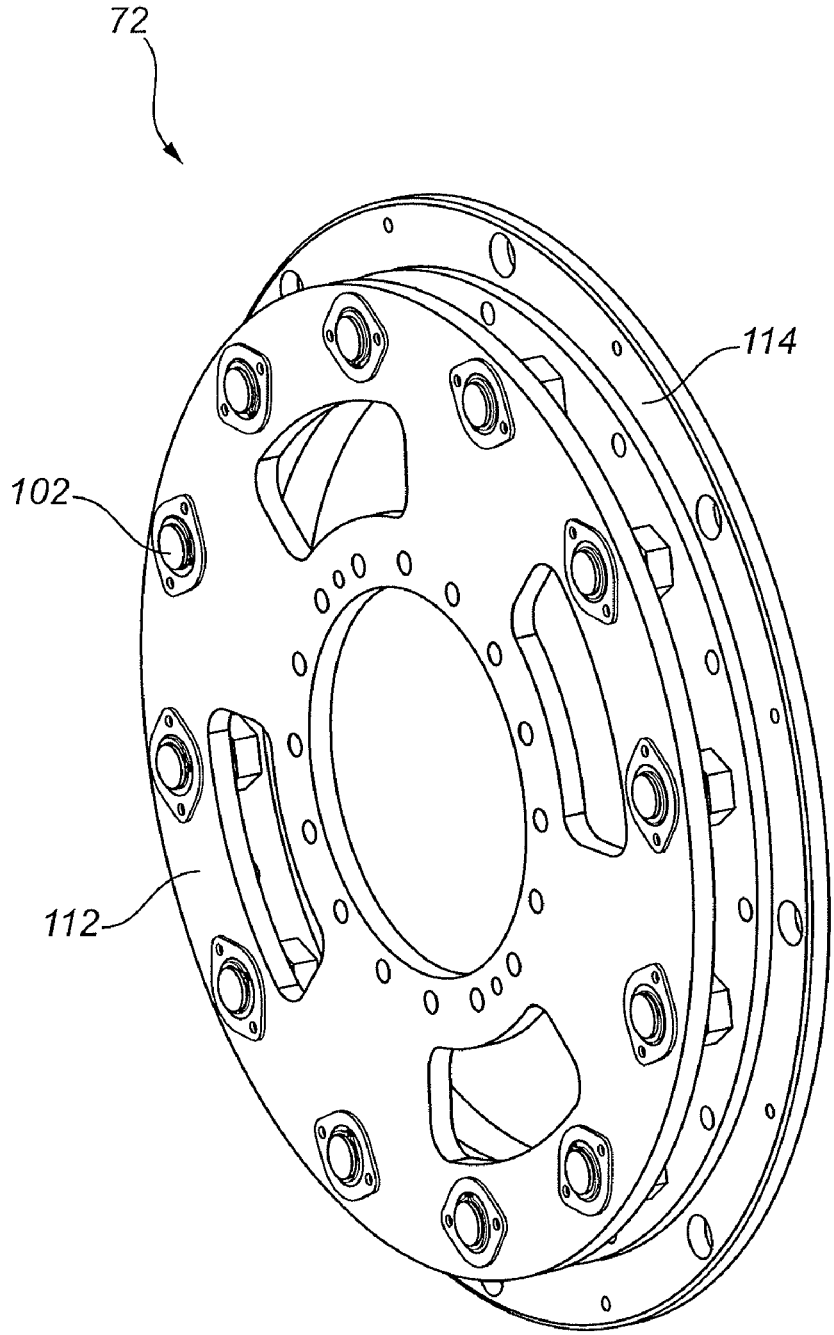
FIG. 12 is a perspective view depicting the oscillating plate assembly of the drum assembly of FIG. 10.
Figure 13:
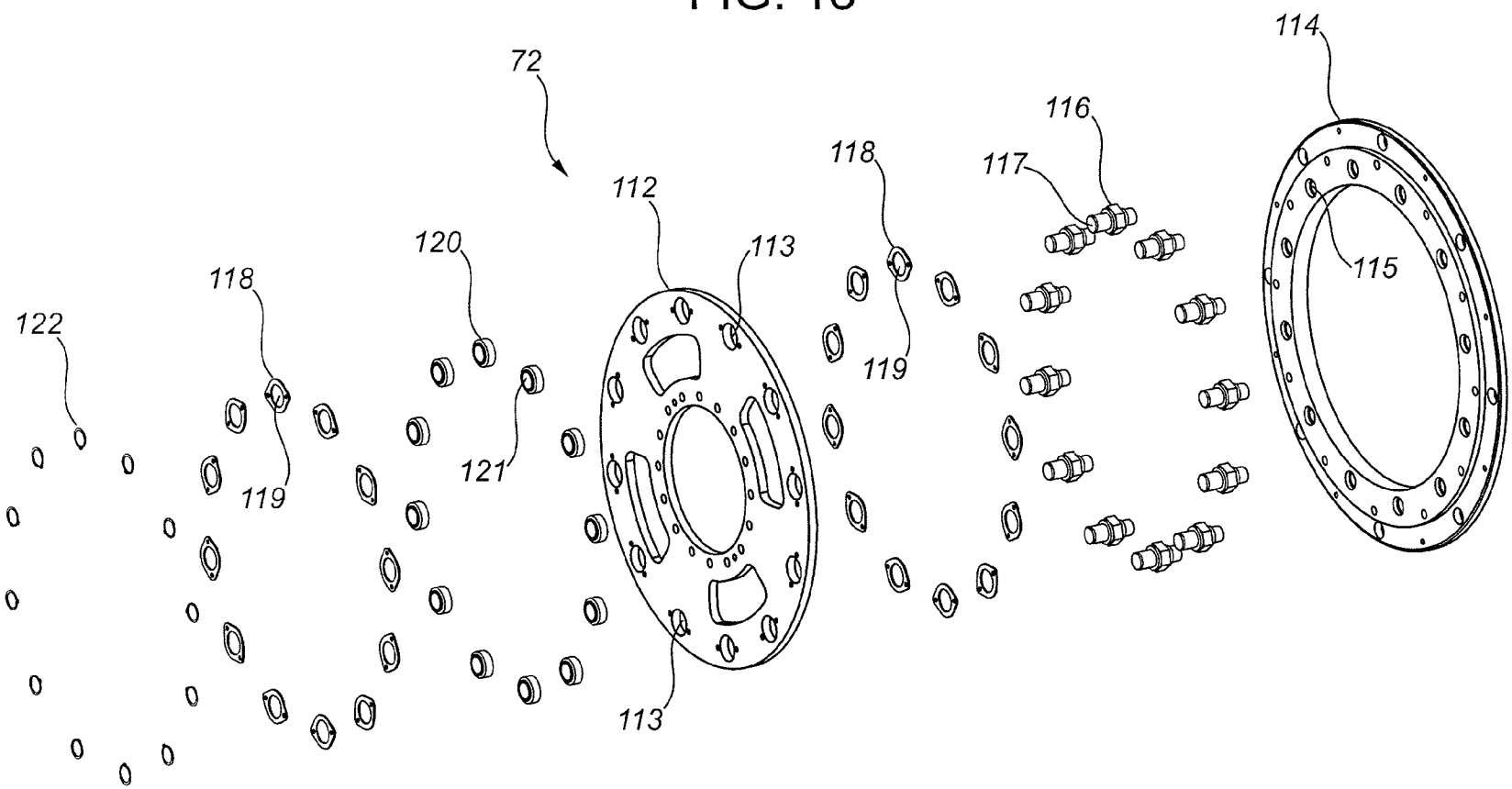
FIG. 13 is an exploded perspective view depicting the oscillating plate assembly of FIG. 12.

Referring to FIGS. 5, 6 and 7, right end 17 of drum shaft 42 can be coupled to cable drum 16 by secondary drive 59. Right end 17 of drum shaft 42 can comprise a pair of tapered roller bearing sets 86 that are supported by bearing cover 88 and oscillating plate assembly 22 that can be bolted to right sidewall 8 of frame 12. Reinforcing plates 11 can strengthen sidewalls 7 and 8 to support the rotation of cable drum 16 in frame 12 when drawworks 10 is being operated. Referring to FIGS. 10 to 13, one embodiment of drum assembly 100 and oscillating plate 72 contained within oscillating plate assembly 22 is shown. Drum assembly 100 can be assembled with left end 19 of drum shaft 42 passing through various components including shim 110, spacers 73, 80 and 81, bearings 76, seals 77 and 82 and bearing covers 108 to couple to sprocket 46. Right end 17 of drum shaft 42 can pass through a first brake drum 18, cable drum 16, a second brake drum 18 to couple with planetary gear subassembly 64 that, in turn, can couple with oscillating plate 72. Referring to FIG. 12, one embodiment of oscillating plate 72 is shown comprising outer plate 112, inner plate 114 and bushing assemblies 102. Referring to FIG. 13, an exploded view of oscillating plate 72 is shown having threaded studs 116, spherical bushings 120, bushing cover plates 118 and snap rings 122. Threaded studs 116 can be fastened to inner plate 114 by threading into openings 115 disposed on inner plate 114. Spherical bushings 120 can be inserted into openings 113 disposed in outer plate 112. Spherical bushings 120 can be sized to fit within openings 113 with minimal clearance but still allow bushings 120 to move within openings 113. Spherical bushings 120 can be secured in openings 113 by attaching bushing cover plates 118 on both sides on outer plate 112 over each opening 113. Once all threaded studs 116 are attached to inner plate 114, inner plate 114 and outer plate 112 can be assembled together by passing threaded studs 116 through openings 119 of a first set of bushing cover plates 118, passageways 121 disposed in spherical bushings 120 and openings 119 of a second set of bushing cover plates 118. Snap rings 122 can then be installed in grooves 117 on threaded studs 116 to keep plates 112 and 114 from pulling apart from each other. In this embodiment, planetary gear subassembly 64 can be fastened to outer plate 112 and inner plate 114 can be fastened to right sidewall 8 of frame 12 via a circular ring member 21 (as shown in FIG. 1). The combination of oscillating plate 72 and circular ring member 21 form oscillating plate assembly 22.

Figure 14:
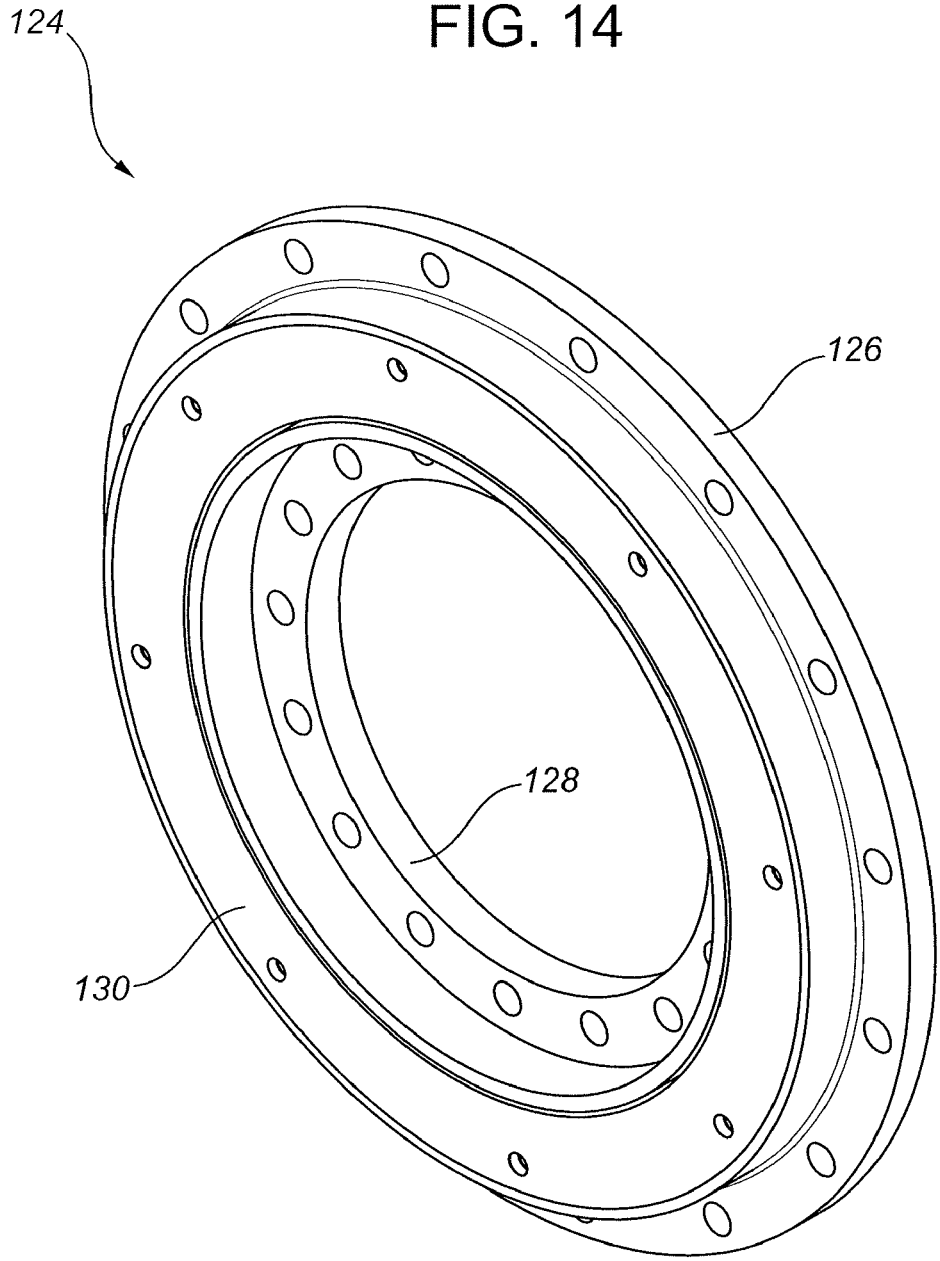
FIG. 14 is a perspective view depicting an alternate embodiment of an oscillating plate assembly.
Figure 15:
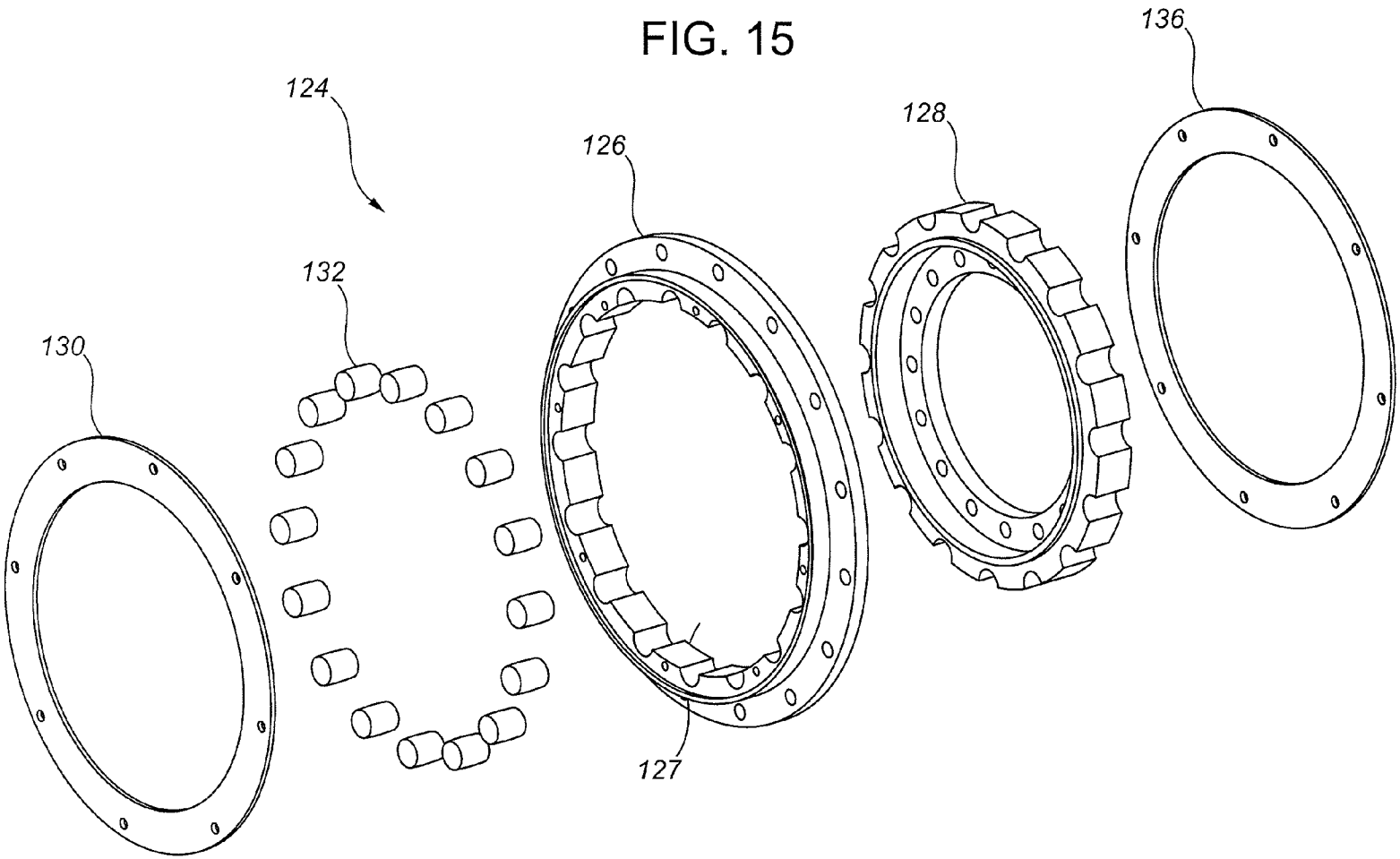
FIG. 15 is an exploded perspective view depicting the oscillating plate assembly of FIG. 14.

Referring to FIGS. 14 and 15, an alternate embodiment of an oscillating plate is shown. In this embodiment, oscillating plate 124 can comprise outer ring 126, inner ring 128, rollers 132, outer cover plate 130 and inner cover plate 136. In this embodiment, inner ring 128 can be disposed in opening 127 of outer ring 126 so that grooves 133 and 134 align with one another to form circular openings. Rollers 132 can be inserted in aligned grooves 133 and 134 and are held in place by outer cover plate 130 and inner cover plate 136 being fastened to outer ring 126. In one embodiment, rollers 132 can be substantially circular in cross-section. In another embodiment, rollers 132 can be substantially cylindrical. In yet another embodiment, the cross-sectional diameter of rollers 132 can taper or narrow from the middle outwardly to each end of rollers 132. It is obvious to those skilled in the art that rollers 132 can be circular, cylindrical or spherical or any other shape that will allow inner ring 128 to move relative to outer ring 126. In one embodiment, planetary gear subassembly 64 can be fastened to inner ring 128 and outer ring 126 can be fastened to right sidewall 8 of frame 12 via a circular ring member 21 (as shown in FIG. 1). The combination of oscillating plate 124 and circular ring member 21 form oscillating plate assembly 22.

In operation, oscillating plate 72 (or oscillating plate 124 in the alternate embodiment) acts to allow the inner and outer plates (or the inner and outer rings in the alternate embodiment) to rotationally move, tilt and/or oscillate relative to one another. The use of an oscillating plate assembly in mounting right end 17 of drum assembly 100 to frame 12 can allow drum shaft 42 and cable drum 16 to be securely mounted in frame 12 yet still allow the rotating components of drum assembly 100 to move or flex slightly in frame 12 when drawworks 10 is in operation. If right end 17 of drum assembly 100 were just simply secured or fastened to frame 12, the vibrations and stresses in the rotating components that occur when drawworks 10 is in operation can result in stress fractures in frame 12 over time and may result in a catastrophic failure of drawworks 10 if left unchecked. The use of oscillating plate assembly 22 to mount right end 17 of drum assembly 100 to frame 12 can reduce or eliminate the probability of such a failure occurring.

Referring back to FIGS. 6 and 7, secondary drive 59 can comprise ring gear housing 60 having ring gear 62 attached thereon, planetary gear sub-assembly 64 having four planetary gears 66 rotatably attached thereto and sun gear 68. Sun gear 68 can be fitted to drum shaft 42. In one embodiment, drum shaft 42 and sun gear 68 can have intermeshing splines 69 whereby sun gear 68 can be securely coupled to right end 17 of drum shaft 42.

In one embodiment, ring gear housing 60 can be operatively coupled to right sidewall 8 of frame 12 via planetary gear cover 84 and oscillating plate assembly 72. Planetary gear sub-assembly 64 can be fastened to the end of cable drum 16 nearest right sidewall 8 via mounting bolts 65. In this embodiment, drum shaft 42 passes through roller bearing 76, seal 82 and spacer 80 which are all supported by bearing housing 75 which, in turn, can be fastened to the right-hand side of cable drum 16 and hub 15. On the left-hand side of cable drum 16, drum shaft can pass through spacer 80, seal 82 and roller bearing 76 which can be secured to the left-hand side of cable drum 16 and hub 15 by cover plate 79. Drum shaft 42 can then pass through spacer 73 before passing through seal 77 and roller bearing 76 which can be supported by bearing housing 78 and secured by cover plate 83. Bearing housing 78 can be fastened to sidewall 7 of frame 12. Drum shaft 42 then passes through spacer 81 and seal 77. Left-hand end 17 of shaft 42 then is coupled to sprocket 42 by key 44.

In operation, as motor 32 rotates drum shaft 42 via primary drive 37, sun gear 68 can rotate planetary gear sub-assembly 64 thereby turning cable drum 16. In one embodiment, sun gear 68 and planetary gear 66 can each have 28 teeth and ring gear 62 can have 112 teeth thereby resulting in a secondary gear reduction ratio of 4:1. Combined with the gear reduction provided by primary drive 37, the overall gear reduction from motor 32 to cable drum 16 can be in the range of 6:1 to 8:1. In a representative embodiment as shown, the overall gear reduction ratio is 7.43:1. A cable (not shown) can be attached to cable drum 16 and passes over roller 14 before ascending to cable pulleys mounted on top of a drilling rig (not shown). The cable can be reeled in or paid out to raise or lower a traveling block within the drilling rig by operating the controls (not shown) of motor controller 34.

Referring to FIGS. 1 to 9, one embodiment of a braking mechanism for the cable drawworks is shown. In this embodiment, brake drums 18 can be attached to each end of cable drum 16. Surrounding each brake drum 18 are brake bands 20. Each brake band 20 has a "live end" and a "dead end". Each live end has a lug 51 affixed to brake band 20. Link 29 can be attached to lug 51 at one end via pin 27. The other end of link 29 can be pivotally attached to brake shaft crank 23 via pin 27. Brake shaft cranks 23 can be attached to main brake shaft 26 which is rotatably mounted on frame 12 substantially parallel to the axis of cable drum 16. Main brake shaft 26 can be made into two sections having coupling 26A joining the two sections together into a single shaft. In one embodiment, each end of brake shaft 26 can pass through a sidewall 8 of frame 12, preferably through flange bearings 94 to permit rotation of brake shaft 26. On each end of brake shaft 26 can be actuator cranks 28. Attached to each actuator crank 28 can be a brake actuator 24. In a representative embodiment, brake actuators 24 can be spring-loaded, pneumatically-operated devices coupled to pneumatic control lines (not shown) such as Maxibrake® model no. MA15623 as manufactured by Haldex Commercial Vehicle Systems of Kansas City, Mo., U.S.A. It should be obvious to those skilled in the art, however, that other types of mechanisms may be used to operate brake shaft 26.

In one embodiment, the dead end of each brake band 20 can have a dead end lug 52 mounted thereon. Equalizer rods 54 can be pivotally attached at one end to each dead end lug 52 via pins 53. The other ends of equalizer rods 54 can pass through pivot blocks 56. Equalizer rods 54 can be threaded and can be secured to pivot blocks 56 with lock nuts 58. Each pivot block 56 can be pivotally attached to an L-shaped equalizer link 90 that can be, in turn, pivotally attached to equalizer lugs 32 welded to floor 9 of frame 12. Equalizer bar 30 can be pivotally attached at each end to an equalizer link 90.

In operation, brake actuators 24 can be activated or pressurized to turn brake shaft 26 thereby loosening tension on brake pads 20 so that cable drum 16 can turn freely. When braking is to be applied to cable drum 16, brake actuators 24 can be relieved of their pressure allowing the internal spring of the actuators to cause actuators 24 to operate actuator cranks 28 and rotate brake shaft 26 thereby causing brake bands 20 to tighten around brake drums 18. As brake bands 20 contact brake drums 18, the frictional forces on brake bands 20 cause equalizer rods 54 to pull up on pivot blocks 56. The mechanical relationship caused by equalizer bar 30 connected to equalizer links 90 results in an automatic equalization of the braking forces on brake drums 18 so that each brake drum 18 experiences the same braking force. This prevents cable drum 16 from twisting along its axis during braking conditions.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

We claim:

1. A cable drawworks for a drilling rig, comprising:

a) a frame adapted for mounting on a drilling rig, the frame having a floor member and two opposing sidewall members;

b) motor means for operating a cable drum, the motor means mounted on the frame, the motor means having a drive shaft;

c) a drum shaft having first and second ends, the drum shaft rotatably disposed in the frame;

d) primary drive means for rotatably coupling the drive shaft to the first end of the drum shaft;

e) the cable drum rotatably mounted on the drum shaft, the cable drum located between the first and second ends on the drum shaft;

f) secondary drive means for rotatably coupling the second end of the drum shaft to the cable drum; and g) an oscillating plate assembly adapted for operatively attaching the secondary drive means to the frame, wherein the secondary drive means can move or flex in the frame when rotating.

2. The cable drawworks as set forth in claim 1 wherein the motor means comprises an alternating current electric motor.

3. The cable drawworks as set forth in claim 2 wherein the alternating current electric motor comprises a 3-phase alternating current electric motor.

4. The cable drawworks as set forth in claim 2 further comprising motor control means for operating the motor means whereby the drawworks is capable of reeling in or paying out a cable attached to the cable drum.

5. The cable drawworks as set forth in claim 4 wherein the motor control means comprises a variable frequency drive controller adapted to control the operation of the alternating current electric motor.

6. The cable drawworks as set forth in claim 1 wherein the primary drive means comprises one or more from the group consisting of a roller chain and a pair of sprockets operatively attached to each of the drive shaft and the first end of the drum shaft, a drive belt and a pair of drive pulleys operatively attached to each of the drive shaft and the first end of the drum shaft, at least a pair of intermeshing gears operatively attached to each of the drive shaft and the first end of the drum shaft, and a planetary gear transmission having a ring gear, a sun gear and a planetary gear set.

7. The cable drawworks as set forth in claim 6 wherein the sun gear is operatively attached to the second end of the drum shaft and the planetary gear set is operatively attached to the cable drum.

8. The cable drawworks as set forth in claim 1 wherein the oscillating plate assembly further comprises:

a) an outer plate configured for operatively attaching to the secondary drive means, the outer plate comprising a plurality of openings;

b) a spherical bushing disposed in each of the openings disposed on the outer plate, each bushing configured to allow a stud to pass therethrough, the bushings further comprising means for retaining the bushings within the openings;

c) an inner plate configured for operatively attaching to one of the sidewall members of the frame, the inner plate further configured to allow the secondary drive means to pass therethrough to operatively attach to the outer plate, the inner plate comprising a plurality of studs projecting therefrom, the plurality of studs configured to substantially align with the bushings disposed in the openings; and d) retaining means for attaching to the studs after they have passed through the bushings thereby operatively coupling the inner plate to the outer plate to form the oscillating plate assembly.

9. The cable drawworks as set forth in claim 8 wherein the retaining means further comprises snap rings and wherein the studs further comprise snap ring grooves configured to receive the snap rings.

10. The cable drawworks as set forth in claim 1 wherein the oscillating plate assembly further comprises:

a) an outer ring having a first opening passing therethrough, the outer ring comprising a plurality of first grooves disposed about an inner edge defined by the first opening, the outer ring configured for operatively attaching to one of the sidewall members of the frame;

b) an inner ring configured to be disposed in the first opening, the inner ring further comprising a plurality of second grooves disposed about its outer perimeter to substantially align with the plurality of first grooves, the inner ring configured to operatively attach to the secondary drive means;

c) a plurality of rollers disposed in the plurality of first and second grooves when the plurality of first and second grooves are aligned relative to one another; and d) retaining means for keeping the inner ring disposed in the first opening and the rollers disposed in the plurality of first and second grooves thereby forming the oscillating plate assembly.

11. The cable drawworks as set forth in claim 10 wherein the rollers are substantially circular in cross-section.

12. The cable drawworks as set forth in claim 11 wherein the cross-sectional diameter of the rollers tapers or narrows from the middle outwardly to each end of the rollers.

13. The cable drawworks as set forth in claim 1 further comprising brake means for braking the rotation of the said cable drum.

14. The cable drawworks as set forth in claim 13 wherein the brake means comprises at least one band brake capable of braking the cable drum.

15. The cable drawworks as set forth in claim 14 wherein the brake means comprises a pair of band brakes, the band brakes capable of braking the cable drum, each band brake operatively coupled to an end of the cable drum.

16. A cable drawworks for a drilling rig, comprising:

a) a frame adapted for mounting on a drilling rig, the frame having a floor member and two opposing sidewall members;

b) a motor mounted on the frame, the motor having a drive shaft;

c) a drum assembly rotatably disposed in the frame, the drum assembly further comprising a drum shaft having first and second ends;

d) primary drive means for rotatably coupling the drive shaft to the first end of the drum shaft;

e) a cable drum concentrically mounted on the drum shaft whereby the cable drum can rotate about the drum shaft, the cable drum located between the first and second ends on the drum shaft;

f) secondary drive means for rotatably coupling the second end of the drum shaft to the cable drum; and g) mounting means for operatively attaching the secondary drive means to the frame, the mounting means configured to allow the secondary drive means to move or flex within the frame when the drawworks is in operation.

17. The cable drawworks as set forth in claim 16 further comprising brake means for braking the rotation of the cable drum.

18. The cable drawworks as set forth in claim 17 wherein the brake means comprises at least one band brake capable of braking the cable drum.

19. The cable drawworks as set forth in claim 18 wherein the brake means comprises a pair of band brakes, the band brakes capable of braking the cable drum, each band brake operatively coupled to an end of the cable drum.

20. The cable drawworks as set forth in claim 16 wherein the motor comprises an alternating current electric motor.

21. The cable drawworks as set forth in claim 20 wherein the alternating current electric motor comprises a 3-phase alternating current electric motor.

22. The cable drawworks as set forth in claim 20 further comprising motor control means for operating the motor whereby the drawworks is capable of reeling in or paying out a cable attached to the cable drum.

23. The cable drawworks as set forth in claim 22 wherein the motor control means comprises a variable frequency drive controller adapted to control the operation of the alternating current electric motor.

24. The cable drawworks as set forth in claim 16 wherein the primary drive means comprises one or more from the group consisting of a roller chain and a pair of sprockets operatively attached to each of the drive shaft and the first end of the drum shaft, a drive belt and a pair of drive pulleys operatively attached to each of the drive shaft and the first end of the drum shaft, at least a pair of intermeshing gears operatively attached to each of the drive shaft and the first end of the drum shaft, and a planetary gear transmission having a ring gear, a sun gear and a planetary gear set.

25. The cable drawworks as set forth in claim 24 wherein the sun gear is operatively attached to the second end of the drum shaft and the planetary gear set is operatively attached to the cable drum.

26. The cable drawworks as set forth in claim 16 wherein the mounting means further comprises an oscillating plate.

27. The cable drawworks as set forth in claim 26 wherein the oscillating plate further comprises:

a) an outer plate configured for operatively attaching to the secondary drive means, the outer plate comprising a plurality of openings;

b) a spherical bushing disposed in each of the openings disposed on the outer plate, each bushing configured to allow a stud to pass therethrough, the bushings further comprising means for retaining the bushings within the openings;

c) an inner plate configured for operatively attaching to one of the sidewall members of the frame, the inner plate further configured to allow the secondary drive means to pass therethrough to operatively attach to the outer plate, the inner plate comprising a plurality of studs projecting therefrom, the plurality of studs configured to substantially align with the bushings disposed in the openings; and d) retaining means for attaching to the studs after they have passed through the bushings thereby operatively coupling the inner plate to the outer plate to form the oscillating plate.

28. The cable drawworks as set forth in claim 27 wherein the retaining means further comprises snap rings and wherein the studs further comprise snap ring grooves configured to receive the snap rings.

29. The cable drawworks as set forth in claim 26 wherein the oscillating plate further comprises:

a) an outer ring having a first opening passing therethrough, the outer ring comprising a plurality of first grooves disposed about an inner edge defined by the first opening, the outer ring configured for operatively attaching to one of the sidewall members of the frame;

b) an inner ring configured to be disposed in the first opening, the inner ring further comprising a plurality of second grooves disposed about its outer perimeter to substantially align with the plurality of first grooves, the inner ring configured to operatively attach to the secondary drive means;

c) a plurality of rollers disposed in the plurality of first and second grooves when the plurality of first and second grooves are aligned relative to one another; and d) retaining means for keeping the inner ring disposed in the first opening and the rollers disposed in the plurality of first and second grooves thereby forming the oscillating plate.

30. The cable drawworks as set forth in claim 29 wherein the rollers are substantially circular in cross-section.

31. The cable drawworks as set forth in claim 30 wherein the cross-sectional diameter of the rollers tapers or narrows from the middle outwardly to each end of the rollers.

* * * * *